US011333421B2

(12) United States Patent
Song et al.

(10) Patent No.: US 11,333,421 B2
(45) Date of Patent: May 17, 2022

(54) REFRIGERATOR

(71) Applicant: Samsung Electronics Co., Ltd., Suwon-si (KR)

(72) Inventors: Joo Hee Song, Suwon-si (KR); Il Sung Bae, Suwon-si (KR); Se Jin Yun, Suwon-si (KR); Jae Pil Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 260 days.

(21) Appl. No.: 16/520,231

(22) Filed: Jul. 23, 2019

(65) Prior Publication Data

US 2020/0033046 A1 Jan. 30, 2020

(30) Foreign Application Priority Data

Jul. 30, 2018 (KR) ..... 10-2018-0088691

(51) Int. Cl.

| | |
|---|---|
| ***F25D 17/06*** | (2006.01) |
| ***F25D 11/02*** | (2006.01) |
| ***F25D 23/06*** | (2006.01) |
| ***F25D 29/00*** | (2006.01) |

(52) U.S. Cl.

CPC ..... *F25D 17/062* (2013.01); *F25D 11/02* (2013.01); *F25D 23/061* (2013.01); *F25D 29/00* (2013.01); *F25D 2317/067* (2013.01)

(58) Field of Classification Search

CPC ..... F25D 17/062; F25D 11/02; F25D 29/00; F25D 23/061; F25D 2317/067; F25D 2500/02; F25D 17/065; F25D 17/045

See application file for complete search history.

(56) References Cited

U.S. PATENT DOCUMENTS 4,229,945 A * 10/1980 Griffin ..... F25D 17/065 62/187
7,076,967 B2 * 7/2006 Lee ..... F25C 1/04 62/353
9,010,145 B2 4/2015 Lim et al.

(Continued)

FOREIGN PATENT DOCUMENTS

CN 101900470 A 12/2010
CN 106871532 A 6/2017

(Continued)

OTHER PUBLICATIONS

ISA/KR, International Search Report and Written Opinion of the International Searching Authority, International Application No. PCT/KR2019/008636, dated Nov. 8, 2019, 3 pages.

(Continued)

*Primary Examiner* — Ana M Vazquez

(57) ABSTRACT

Disclosed herein is a refrigerator capable of improving a user's convenience by locating a knob for adjusting a temperature of a cooling container above the cooling container. The refrigerator includes: a first storage room; a second storage room positioned below the first storage room; a cooling container positioned in the inside of the first storage room, and forming a cooling space maintained at a temperature that is different from a temperature of the first storage room; and a knob configured to adjust a temperature of the cooling space and positioned above the cooling container.

16 Claims, 9 Drawing Sheets

(56) References Cited

U.S. PATENT DOCUMENTS

| | | | | |
|---|---|---|---|---|
| 10,378,811 | B2 | 8/2019 | Lee et al. | |
| 11,015,858 | B2 | 5/2021 | Lee | |
| 2004/0138727 | A1 | 7/2004 | De Taboada et al. | |
| 2017/0074576 | A1 | 3/2017 | Lee et al. | |
| 2017/0292766 | A1* | 10/2017 | Lee | F25D 17/065 |

FOREIGN PATENT DOCUMENTS

| | | | | |
|---|---|---|---|---|
| CN | 106895636 | A | 6/2017 | |
| CN | 106895637 | A | 6/2017 | |
| CN | 107560285 | A | 1/2018 | |
| EP | 3144610 | A1 | 3/2017 | |
| JP | S62-233667 | A | 10/1987 | |
| JP | H03-125888 | A | 5/1991 | |
| JP | H06-1145 | B2 | 1/1994 | |
| JP | 4224102 | B2 | 2/2009 | |
| KR | 20-2000-0011261 | U | 6/2000 | |
| KR | 20-0309846 | Y1 | 4/2003 | |
| KR | 10-2005-0105340 | A | 11/2005 | |
| KR | 10-1640600 | B1 | 7/2016 | |
| KR | 10-2017-0033702 | A | 3/2017 | |
| KR | 20170033702 | A * | 3/2017 | F25D 25/025 |
| KR | 10-1815580 | B1 | 1/2018 | |
| WO | 2017/094058 | A1 | 6/2017 | |

OTHER PUBLICATIONS

Supplementary European Search Report dated Jul. 16, 2021, in connection with European Patent Application No. 19843942.4, 7 pages.

Office Action dated Jan. 4, 2022 in connection with Chinese Patent Application No. 201980050607.1, 19 pages.

* cited by examiner

REFRIGERATOR

CROSS-REFERENCE TO RELATED APPLICATION

This application is based on and claims priority under 35 U.S.C. § 119 to Korean Patent Application No. 10-2018-0088691, filed on Jul. 30, 2018 in the Korean Intellectual Property Office, the disclosure of which is incorporated by reference herein in its entirety.

BACKGROUND

1. Field

The disclosure relates to a refrigerator including a storage container capable of adjusting the inside temperature.

2. Description of the Related Art

In general, a refrigerator supplies cool air generated by an evaporator to a storage room to maintain various foods fresh for a long time. The storage room of the refrigerator is partitioned into a refrigerating room that is maintained at about 3° C. above zero to keep foods refrigerated, and a freezing room that is maintained at about 20° C. below zero to keep foods frozen. In the storage room, a storage container is positioned to store foods. The storage container is configured to be taken out of the storage room or put into the storage room.

The inside temperature of the storage container is maintained, generally, at the same temperature as that of the refrigerating room. However, many foods have different optimal storage temperatures. For this reason, a need for storage containers capable of maintaining a different temperature from the inside temperature of a storage room is increasing.

When a knob for adjusting the temperature of the storage container is located behind the storage container, a user should take the storage container out of the storage room to access the knob, which deteriorates the user's convenience.

SUMMARY

Therefore, it is an aspect of the disclosure to provide a refrigerator capable of improving a user's convenience by locating a knob for adjusting a temperature of a storage container above the storage container.

It is another aspect of the disclosure to provide a refrigerator capable of reducing manufacturing cost and improving product competitiveness by omitting a motorized damper.

It is another aspect of the disclosure to provide a refrigerator capable of preventing overcooling of a storage container, while locating a flow control member for adjusting the flow of cool air above a cool air outlet for discharging cool air to the storage container.

It is another aspect of the disclosure to provide a refrigerator capable of preventing overcooling of a storage container by installing a flow path for guiding cool air to the storage container above a flow control member for adjusting the flow of cool air.

Additional aspects of the disclosure will be set forth in part in the description which follows and, in part, will be obvious from the description, or may be learned by practice of the disclosure.

In accordance with an aspect of the disclosure, a refrigerator includes: a first storage room; a second storage room positioned below the first storage room; a cooling container positioned in the inside of the first storage room, and forming a cooling space maintained at a temperature that is different from a temperature of the first storage room; and a knob configured to adjust a temperature of the cooling space and positioned above the cooling container.

The refrigerator may further include: a duct including a flow path for guiding cool air to the first storage room and the cooling space; and a flow control unit configured to be movable on the flow path and configured to adjust a degree of opening of the flow path.

The knob may be configured to adjust a position of the flow control unit.

The flow path may include: a first flow path for guiding the cool air to the flow control unit from the second storage room; a second flow path for guiding the cool air to the first storage room from the flow control unit; and a third flow path for guiding the cool air to the cooling space from the flow control unit.

The duct may further include a partition wall partitioning the first flow path from the third flow path to prevent cool air of the first flow path from entering the third flow path.

The third flow path may include: a first partial flow path diverging from the second flow path and extending downward; and a second partial flow path extending in a side direction from the first partial flow path.

When the cooling container is taken out of the first storage room in a first direction, the first flow path may be partitioned from the second partial flow path in the first direction by the partition wall.

The flow control unit may include: a case including a flow control hole which is positioned on the flow path and through which the cool air passes; and a flow control member slidingly coupled with the case and configured to adjust a size of the flow control hole.

The knob may be slidingly coupled with the case and configured to adjust a position of the flow control member.

The knob may be integrated into the flow control member and configured to move together with the flow control member.

The flow control member may be configured to move between a first position for opening the flow control hole to a first size and a second position for opening the flow control hole to a second size that is different from the first size.

The case may include an accommodating portion which the flow control member is inserted into or taken out of. When the flow control member is inserted into the accommodating portion, a size of the flow control hole may increase, and when the flow control member is taken out of the accommodating portion, a size of the flow control hole may decrease.

The flow control member may be in surface contact with the accommodating portion to prevent the cool air from leaking between the flow control member and the accommodating portion.

The refrigerator may further include a storage container positioned in the inside of the first storage room and positioned above the cooling container, and the knob may be positioned above the storage container.

An evaporator configured to generate cool air may be positioned in the second storage room.

In accordance with another aspect of the disclosure, a refrigerator includes: a first storage room; a second storage room positioned below the first storage room, and including an evaporator configured to generate cool air; a cooling container forming a cooling space maintained at a temperature that is different from a temperature of the first storage room, wherein the cooling container is configured to be taken out in a first direction from the first storage room; and a first flow path for guiding the cool air to the first storage room; and a second flow path for guiding the cool air to the cooling space, the second flow path being partitioned in the first direction from the first flow path to prevent cool air of the first flow path from entering the second flow path.

The refrigerator may further include: a flow control unit movably positioned on the first flow path, and configured to adjust a degree of opening of the first flow path; and a knob configured to adjust a position of the flow control unit.

The knob may be positioned above the cooling container.

The second flow path may include: a first partial flow path diverging from the first flow path from above the flow control unit, and extending downward; and a second partial flow path extending in a side direction from the first partial flow path The refrigerator may further include a partition wall partitioning the first flow path from the second partial flow path in the first direction.

The flow control unit may include: a case including a flow control hole which is positioned on the flow path and through which the cool air passes; and a flow control member slidingly coupled with the case and configured to adjust a size of the flow control hole.

In accordance with another aspect of the disclosure, a refrigerator includes: a first storage room; a second storage room positioned below the first storage room, wherein an evaporator configured to generate cool air is positioned in the second storage room; a cooling container positioned in the inside of the first storage room, and forming a cooling space maintained at a temperature that is different from a temperature of the first storage room; and a flow control member positioned on a flow path for guiding cool air generated by the evaporator to the cooling space from the second storage room, and configured to adjust a degree of opening of the flow path; a cool air outlet configured to discharge the cool air to the cooling space, and positioned lower than the flow control member; and a partition wall partitioning the cool air outlet from the flow path to prevent cool air below the flow control member from being discharged to the cool air outlet.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 4 illustrates an enlarged view of a portion of the refrigerator shown in

FIG. 3;

DETAILED DESCRIPTION

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations illustrated in the embodiments and the drawings described in the present disclosure should not be considered limiting, and thus it is to be understood that various modified examples, which may replace the embodiments and the drawings described in the present specification, are possible when filing the present application.

The terms used in the present specification are merely used to describe particular embodiments, and are not intended to limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms "first," "second," etc. may be used herein to describe various components, these components should not be limited by these terms. These terms are only used to distinguish one component from another. For example, a first component could be termed a second component, and, similarly, a second component could be termed a first component, without departing from the scope of the disclosure.

Hereinafter, embodiments of the disclosure will be described in detail with reference to the accompanying drawings.

Figure 1:
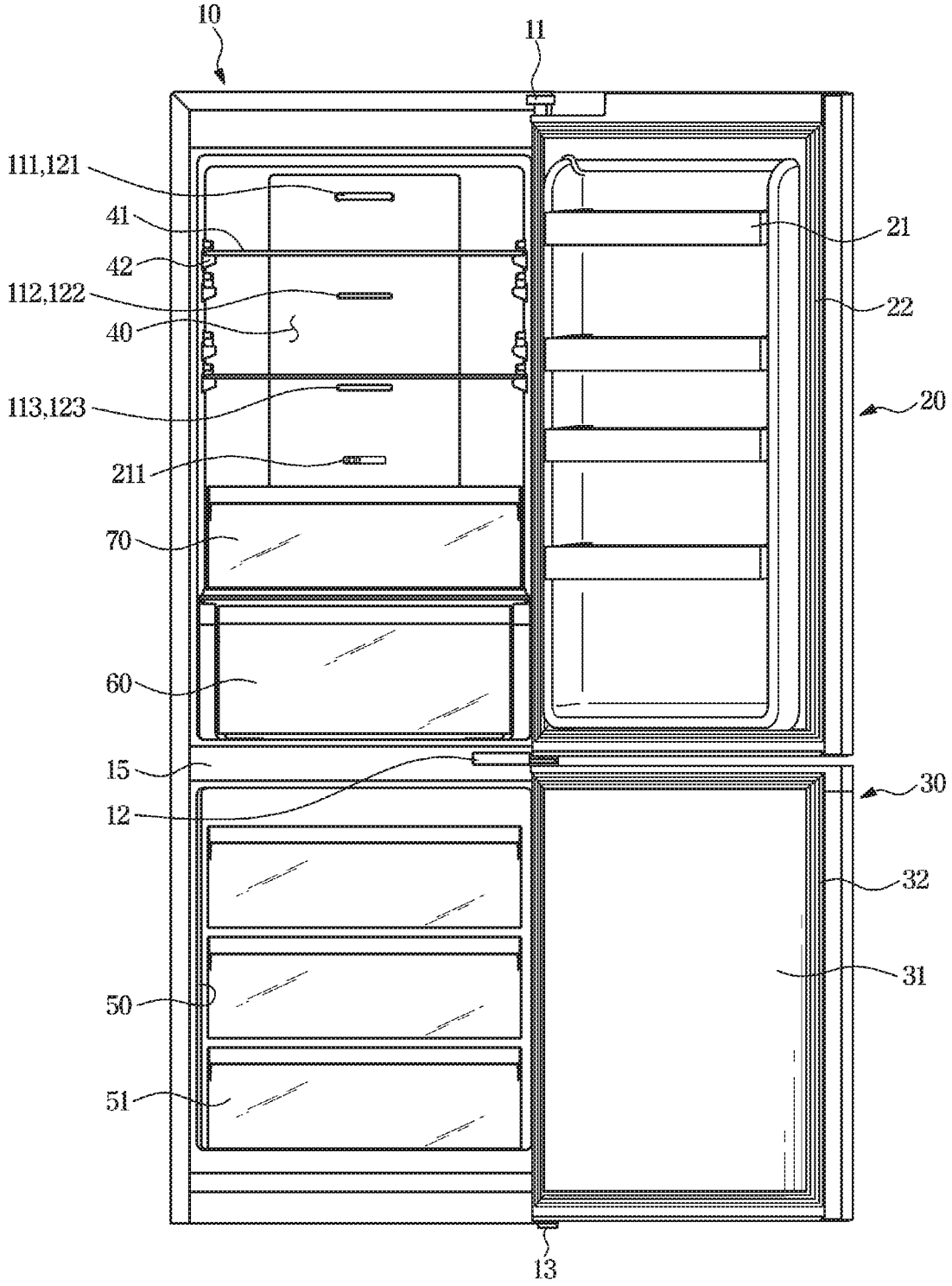
FIG. 1 illustrates a front view of a refrigerator according to an embodiment of the disclosure.

FIG. 1 is a front view of a refrigerator according to an embodiment of the disclosure.

A refrigerator 1 according to an embodiment of the disclosure may include a main body 10, a first storage room 40 and a second storage room 50 positioned vertically in the inside of the main body 10, and a plurality of doors 20 and 30 positioned on front portions of the first and second storage rooms 40 and 50 to open or close the first and second storage rooms 40 and 50.

The refrigerator 1 may include components, such as a compressor (not shown), a condenser 53 (see FIG. 3), an expander (not shown), and an evaporator 52 (see FIG. 3), to constitute the same cooling cycle as general refrigerators.

In the refrigerator 1 according to an embodiment of the disclosure, the first storage room 40 may be used as a refrigerating room, and the second storage room 50 may be used as a freezing room. The first storage room 40 and the second storage room 50 may be partitioned by a horizontal partition wall 15. In the second storage room 50, the evaporator 52 for generating cool air may be positioned.

The doors 20 and 30 may be rotatable with respect to the main body 10. The doors 20 and 30 may include a first door 20 for opening or closing the first storage room 40 and a second door 30 for opening or closing the second storage room 50.

The first door 20 may be rotatable with respect to the main body 10 by a first hinge 11 positioned on a upper portion of the main body 10 and a second hinge 12 positioned on the horizontal partition wall 15 of the main body 10. The second door 30 may be rotatable with respect to the main body 10 by the second hinge 12 and a third hinge 13 positioned on a lower portion of the main body 10.

The doors 20 and 30 may include gaskets 22 and 32, respectively, and the gaskets 22 and 32 may seal up gaps between the storage rooms 40 and 50 and the doors 20 and 30 to prevent cool air from leaking out.

On a rear surface of the first door 20, a door guard 21 may be positioned. In the door guard 21, bottom plates on which drinks are stored, etc. may be accommodated. Also, a plurality of door guards 21 may be provided.

On a rear surface of the second door 30, a plate 31 made of a metal may be positioned. Although the door 30 is opened, the plate 31 may be maintained in a cold state. When the door 30 is opened and closed, the plate 31 may prevent an inside temperature of the second storage room 50 from rising rapidly due to outside warm air. That is, the plate 31 may reduce a change in temperature when the second door 30 is opened and closed.

In the inside of the first storage room 40, a shelf 41 and a shelf support 42 for slidably supporting the shelf 41 may be provided. The numbers of the shelf 41 and the shelf support 42 may change according to a design specification.

In the inside of the first storage room 40, a cooling container 60 and a storage container 70 may be provided.

An inside temperature of the cooling container 60 may be different from that of the first storage room 40. For example, an inside temperature of the cooling container 60 may be lower than that of the first storage room 40 and higher than that of the second storage room 50. The inside temperature of the cooling container 60 may be adjusted by a knob 211.

The knob 211 may be configured to adjust the inside temperature of the cooling container 60. The knob 211 may move between a first position for setting the inside temperature of the cooling container 60 to a first temperature and a second position for setting the inside temperature of the cooling container 60 to a second temperature. The first temperature may be a maximum temperature of the cooling container 60, and the second temperature may be a minimum temperature of the cooling container 60. According to an embodiment of the disclosure, the first temperature may be lower than the inside temperature of the first storage room 40.

The knob 211 may be positioned on a rear surface of the first storage room 40, more particularly, above the cooling container 60.

Because the knob 211 is positioned above the cooling container 60 and the storage container 70, a user may not need to take the cooling container 60 or the storage container 70 out of the first storage room 40 to adjust the position of the knob 211. Accordingly, the usability of the refrigerator 1 may be improved.

The inside temperature of the storage container 70 may be equal to that of the first storage room 40. A plurality of storage containers 70 may be provided according to a design specification. The storage container 70 may be provided in the second storage room 50, without being provided in the first storage room 40.

In the rear surface of the first storage room 40, a plurality of first cool air outlets 111, 121, 112, 122, 113, and 123 may be provided to discharge cool air of the second storage room 50 to the first storage room 40. The number of the first cool air outlets 111, 121, 112, 122, 113, and 123 may be four or more, or two or less.

In the second storage room 50, a plurality of storage containers 51 may be provided. Because the inside temperature of the second storage room 50 is lower than that of the first storage room 40, a temperature difference between the inside temperature of the second storage room 50 and an outside temperature may be greater than a temperature difference between the inside temperature of the first storage room 40 and the outside temperature. Accordingly, a change in temperature when the second storage room 50 opens may be greater than a change in temperature when the first storage room 40 opens. To reduce a change in inside temperature of the second storage room 50 when the second door 30 opens, the storage containers 51, instead of shelves, may be provided in the inside of the second storage room 50.

Figure 2:
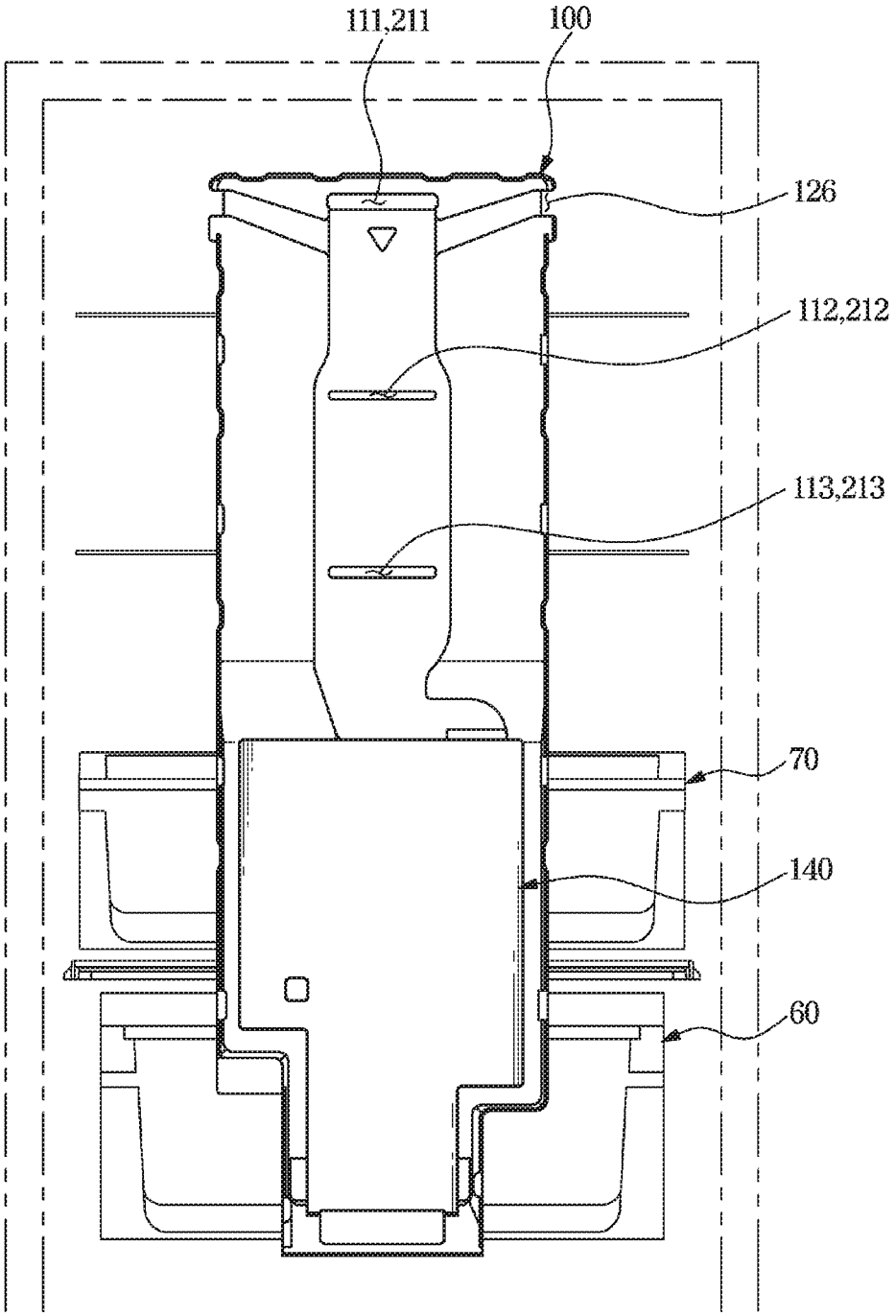
FIG. 2 illustrates a rear view of some components in a refrigerator according to an embodiment of the disclosure.
Figure 3:
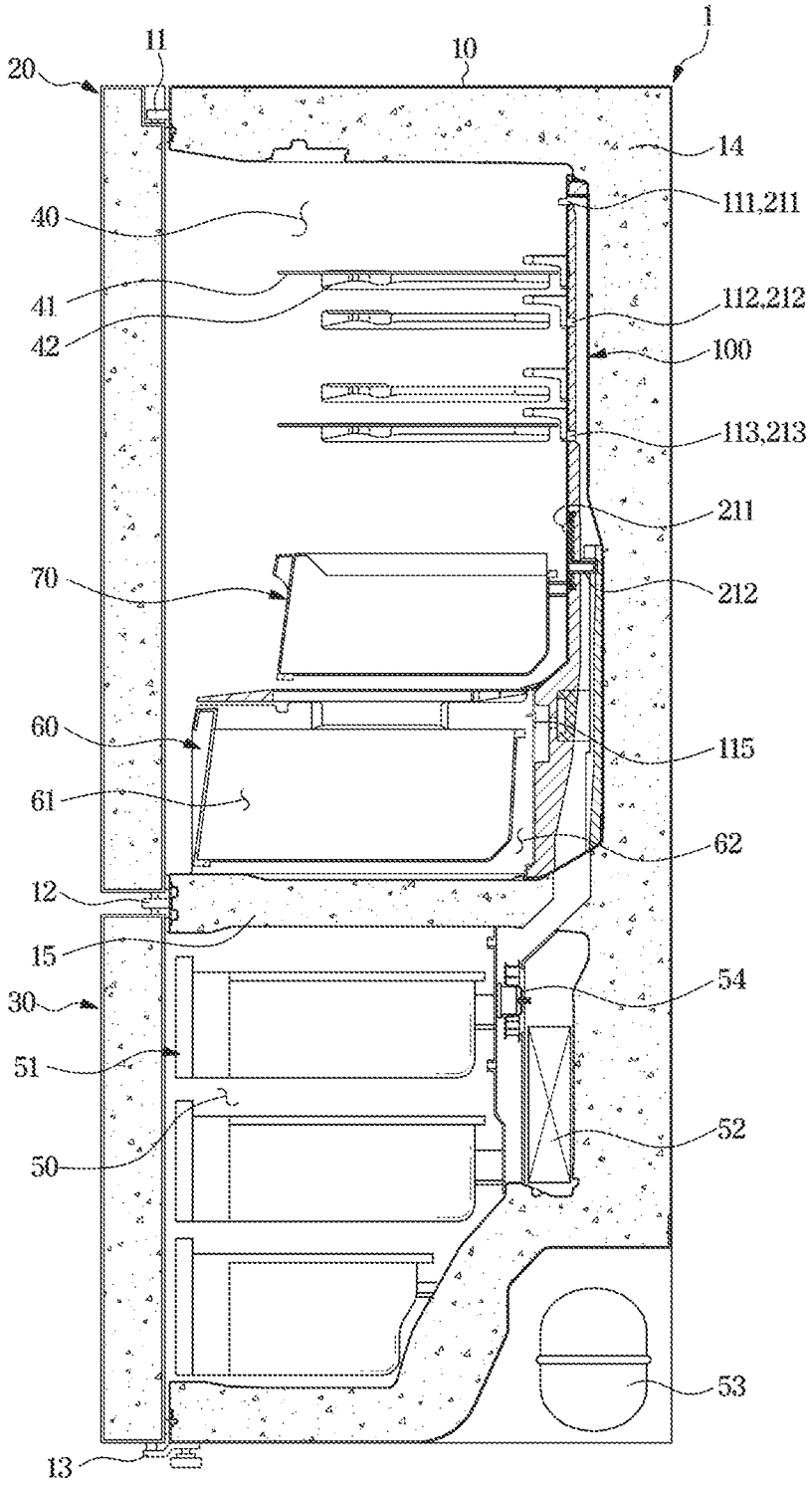
FIG. 3 illustrates a side cross-sectional view of a refrigerator according to an embodiment of the disclosure.

FIG. 2 is a rear view of some components in a refrigerator according to an embodiment of the disclosure, and FIG. 3 is a side cross-sectional view of a refrigerator according to an embodiment of the disclosure.

Referring to FIGS. 2 and 3, in the rear surface of the first storage room 40, a duct assembly 100 may be provided to guide cool air of the second storage room 50 to the first storage room 40 and a cooling chamber 62.

The duct assembly 100 may be positioned between the first storage room 40 and an insulator 14 embedded into the main body 10.

In the second storage room 50, an evaporator 52 for generating cool air and a fan 54 for blowing cool air generated by the evaporator 52 to the first storage room 40 and the cooling chamber 62 may be provided.

The cooling chamber 62 may accommodate the cooling container 60. As described above, the cooling container 60 may be taken out of the first storage room 40 or put into the first storage room 40. More specifically, the cooling container 60 may be taken out of or put into the cooling chamber 62. An inside temperature of the cooling chamber 62 may be equal to that of the cooling container 60. The cooling container 60 may have a cooling space 61 maintained at the same temperature as the cooling chamber 62. A temperature of the cooling space 61 may be different from that of the first storage room 40.

Figure 4:
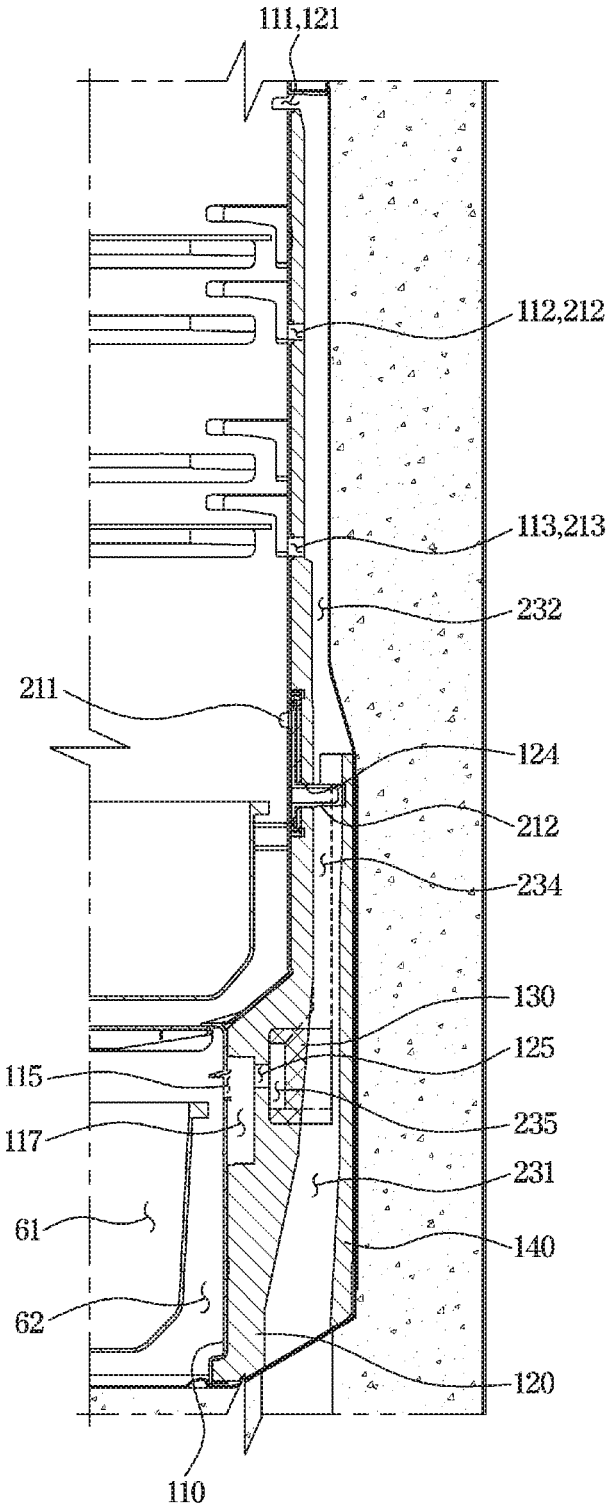

FIG. 4 is an enlarged view of a portion of the refrigerator shown in FIG. 3.

Referring to FIG. 4, cool air generated by the evaporator 52 may move to the first storage room 40 and the cooling chamber 62 through the duct assembly 100.

The cool air may move upward from the second storage room 50 through a first flow path 231. The first flow path 231 and a second partial flow path 235 which will be described later may be partitioned by a partition wall 130. The partition wall 130 may prevent cool air of the first flow path 231 from flowing to the first partial flow path 234. Accordingly, cool air entered the first flow path 231 from the second storage room 50 may move upward without leaking to the second partial flow path 235.

The first flow path 231 may extend from the second storage room 50 to a flow control member 212. Accordingly, the flow control member 212 may be positioned at an end of the first flow path 231. The flow control member 212 may be slidable, and a size of a flow control hole 221 (see FIG. 8) may change according to a position of the flow control member 212. The position of the flow control member 212 may be adjusted by the knob 211, which will be described in detail, later.

A part of cool air passed through the flow control member 212 may move upward along a second flow path 232 and then be discharged to the inside of the first storage room 40.

On the second flow path 232, the plurality of first cool air outlets 111, 121, 112, 122, 113, and 123 may be formed, so that cool air may be discharged to the first storage room 40 through the plurality of first cool air outlets 111, 121, 112, 122, 113, and 123.

The remaining part of the cool air passed through the flow control member 212 may move downward along a third flow path and then be discharged to the cooling chamber 62.

The third flow path may include a first partial flow path 234 and a second partial flow path 235.

The first partial flow path 234 may extend downward from above the flow control member 212. The first partial flow path 234 and the first flow path 231 may be positioned left and right, and the first partial flow path 234 and the first flow path 231 may be partitioned by a partition wall (a reference number is omitted, see FIG. 8) extending vertically.

The second partial flow path 235 may extend to one side from one end of the first partial flow path 234. In the second partial flow path 235, a cool air hole 125 may be formed to pass cool air.

The cool air hole 125 may connect the second partial flow path 235 to a cool air storage 117. Cool air may pass through the cool air hole 125, move to the cool air storage 117, and then, be discharged to the cooling chamber 62 through a second cool air outlet 115 formed in the cool air storage 117, although not limited thereto. The second cool air outlet 115 for discharging cool air to the cooling chamber 62 may be provided directly on the second partial flow path 235. That is, cool air may be discharged to the cooling chamber 62 through the second cool air outlet 115 directly from the second partial flow path 235, not via the cool air hole 125 and the cool air storage 117.

Figure 5:
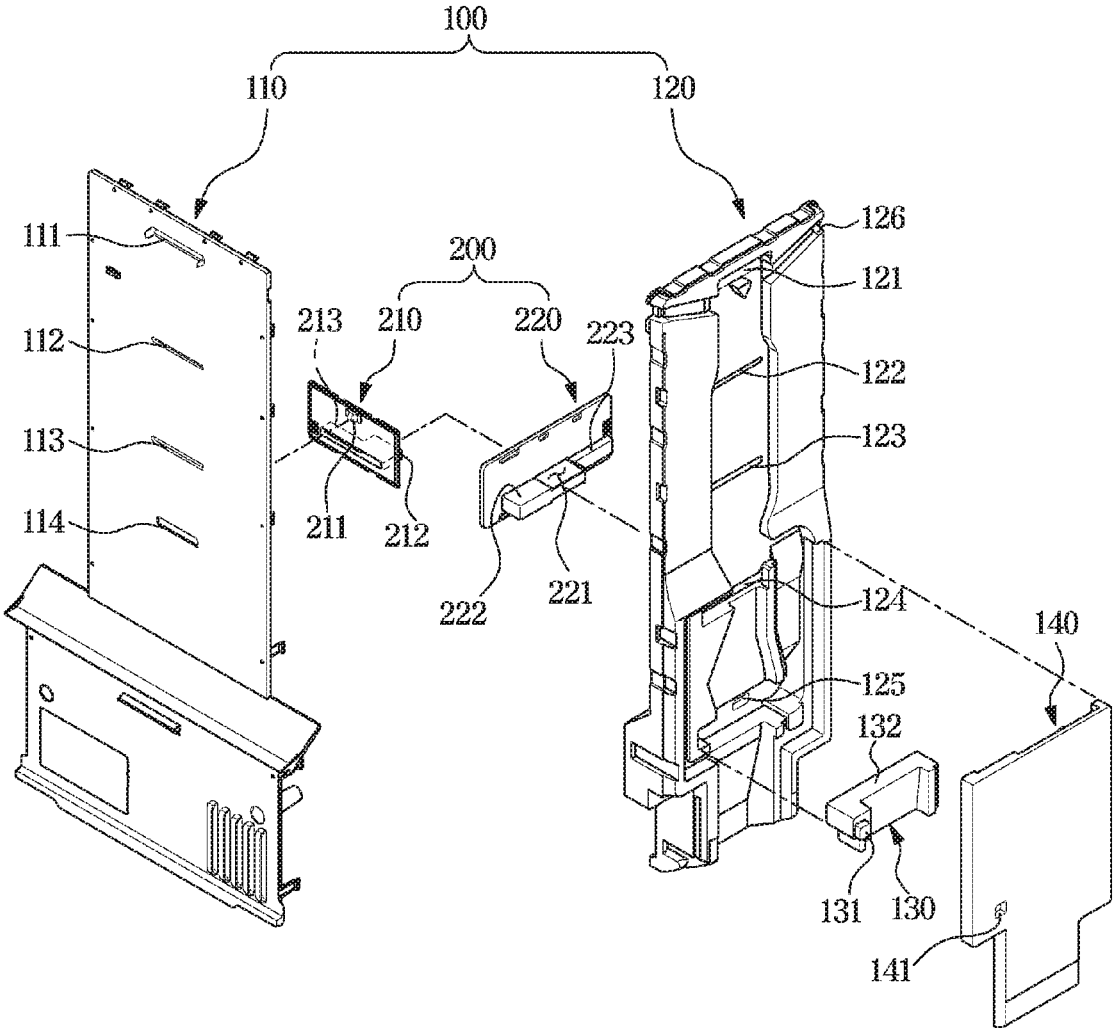
FIG. 5 illustrates an exploded perspective view of a duct assembly in a refrigerator according to an embodiment of the disclosure.

FIG. 5 is an exploded perspective view of a duct assembly in a refrigerator according to an embodiment of the disclosure.

Referring to FIG. 5, the duct assembly 100 may include a first housing 110, a second housing 120, a partition wall 130, and a cover 140.

The first housing 110 may be installed on a rear surface of the first storage room 40. The second housing 120 may be coupled with a rear surface of the first housing 110.

The first housing 110 may include the plurality of outlets 111, 112, and 113. The plurality of outlets 111, 112, and 113 may be arranged vertically to discharge cool air to the first storage room 40. The number and position of the plurality of outlets 111, 112, and 113 may change.

The first housing 110 may include a knob hole 114 into which the knob 211 is inserted. The knob hole 114 may be larger than the knob 211 such that the knob 211 moves between the first position and the second position. The knob hole 114 may extend left and right such that the knob 211 moves left and right in the knob hole 114.

The second housing 120 may include the plurality of outlets 121, 122, and 123 to correspond to the plurality of outlets 111, 112, and 113. The plurality of outlets 112, 122, and 123 may form the first cool air outlets 111, 121, 112, 122, 113, and 123 together with the plurality of outlets 111, 112, and 113.

In an upper side of the second housing 120, a plurality of side outlets 126 may be formed to discharge cool air to the first storage room 40. The side outlets 126 may function to evenly discharge cool air to the inside of the first storage room 40. The position and number of the side outlets 126 may change.

The second housing 120 may include an insertion hole 124 into which the flow control member 212 and a first accommodating portion 222 are inserted. The insertion hole 124 may have a size corresponding to that of the first accommodating portion 222 to prevent cool air from leaking between the insertion hole 124 and the first accommodating portion 222.

The partition wall 130 may be coupled with the second housing 120. The partition wall 130 may partition the first partial flow path 234 from the first flow path 231 to prevent cool air of the first flow path 231 from leaking to the second partial flow path 235.

The partition wall 130 may include a partition portion 132 partitioning the second partial flow path 235 from the first flow path 231, and a protrusion 131 that is inserted in a coupling hole 141 of the cover 140.

The cover 140 may cover a part of a rear surface of the second housing 120. The cover 140 may be coupled with the rear surface of the second housing 120. The cover 140 may include the coupling hole 141, and the protrusion 131 of the partition wall 130 may be inserted in the coupling hole 141.

The cover 140 may prevent cool air of the first flow path 231, the first partial flow path 234, and the second partial flow path 235 from leaking in a rear direction from the second housing 120.

The duct assembly 100 may include a flow control unit 200. The flow control unit 200 may be coupled with the duct assembly 100 to adjust a degree of opening of the flow path.

The flow control unit 200 may include a moving member 210 and a case 220 with which the moving member 210 is coupled. The flow control unit 200 may be positioned between the first housing 110 and the second housing 120.

Figure 6:
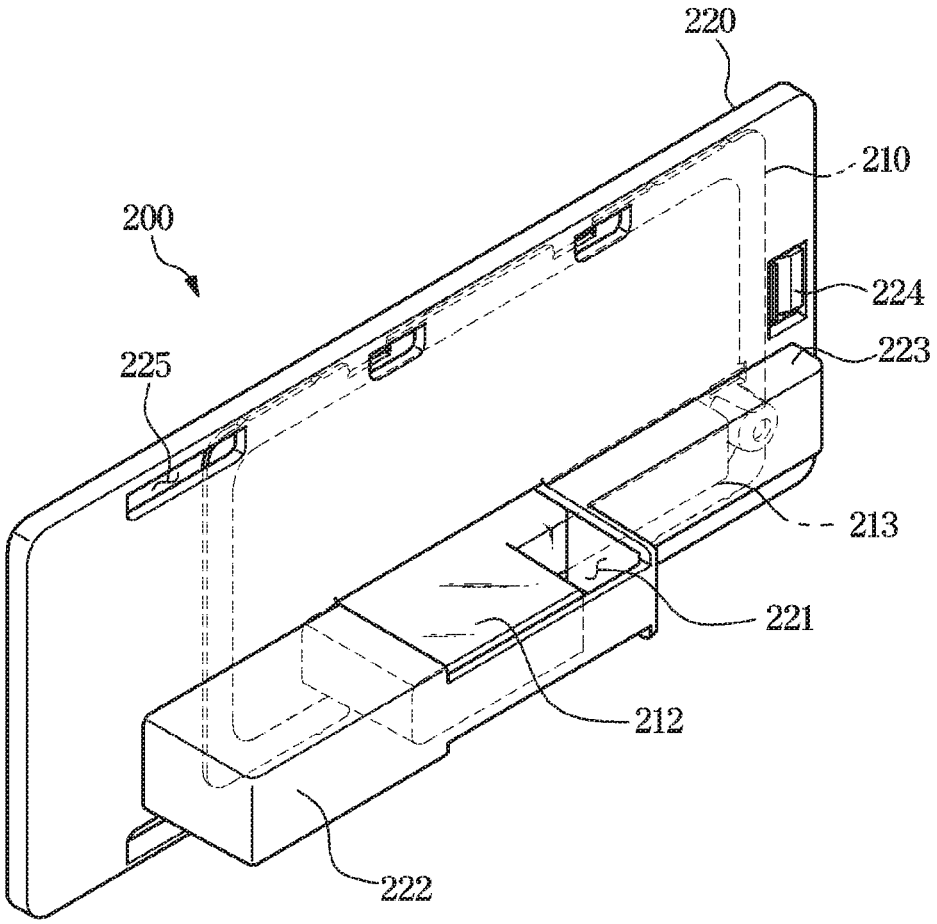
FIG. 6 illustrates a front perspective view of a flow control unit in a refrigerator according to an embodiment of the disclosure.
Figure 7:
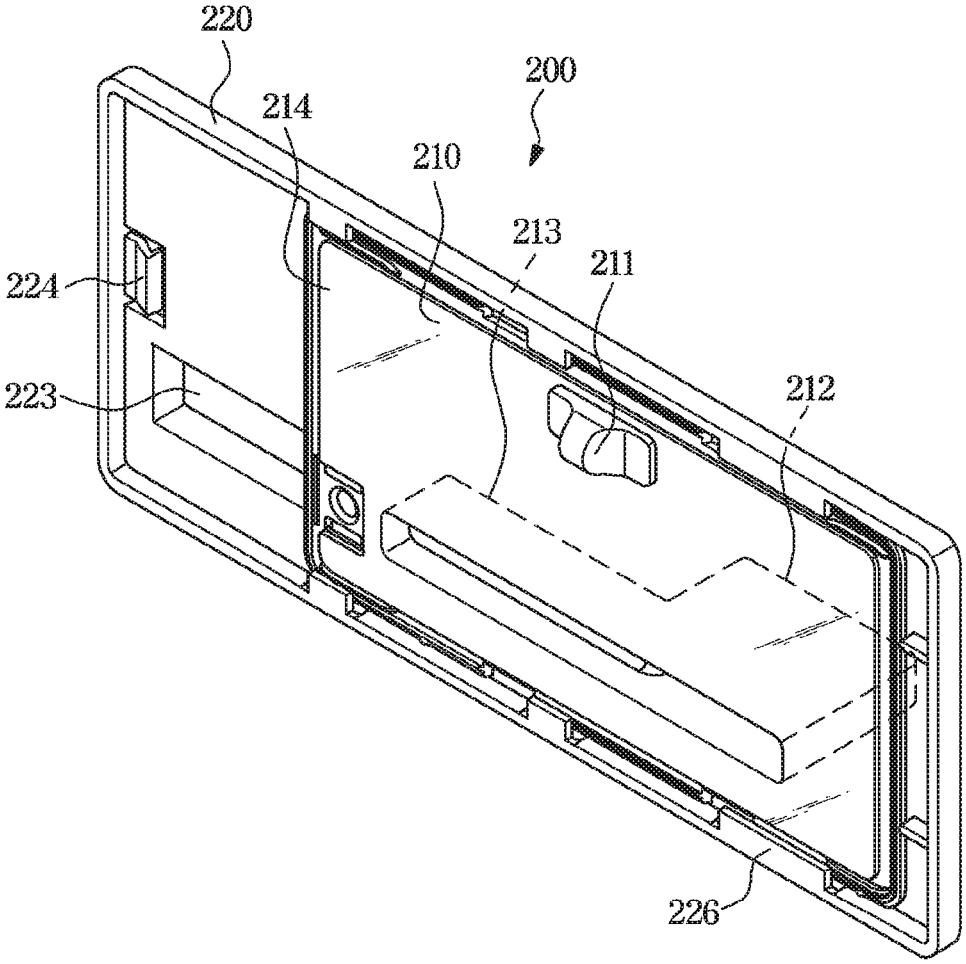
FIG. 7 illustrates a rear perspective view of a flow control unit in a refrigerator according to an embodiment of the disclosure.

FIG. 6 is a front perspective view of a flow control unit in a refrigerator according to an embodiment of the disclosure, and FIG. 7 is a rear perspective view of a flow control unit in a refrigerator according to an embodiment of the disclosure.

Hereinafter, the flow control unit 200 will be described in detail.

Referring to FIGS. 6 and 7, the case 220 may include a flow control hole 221, the first accommodating portion 222 and a second accommodating portion 223 positioned to both sides of the flow control hole 221, a bumper 224, a friction reducing hole 225, and a coupling protrusion 226.

The moving member 210 may include the knob 211, the flow control member 212, an insertion portion 213, and a connecting portion 214.

The moving member 210 may be coupled with a rear surface of the case 220. The case 220 may include a plurality of coupling protrusions 226 arranged along a circumference of the rear surface of the case 220. A predetermined gap may be formed between the coupling protrusions 226 and the rear surface of the case 220. The coupling protrusion 226 may have elasticity.

The moving member 210 may be inserted into the gap formed between the coupling protrusion 226 and the rear surface of the case 220 by using the elasticity of the coupling protrusions 226. After the moving member 210 is inserted into the gap, the moving member 210 may slide in left and right directions.

In the circumference of the case 220, a plurality of friction reducing holes 225 may be formed. The moving member 210 may be inserted between the rear surface of the case 220 and the coupling protrusions 226 to slide. When the moving member 210 slides, a friction may occur by the coupling protrusions 226 and the rear surface of the case 220. The friction reducing holes 225 may reduce a contact area between the moving member 210 and the rear surface of the case 220, thereby reducing a friction between the moving member 210 and the case 220.

When the moving member 210 moves to the first position, the bumper 224 may enable the moving member 210 to be smoothly located at the first position. More specifically, when the moving member 210 contacts the bumper 224 rapidly, the bumper 224 may be elastically deformed to more or less increase a moving distance of the moving member 210. When the moving distance of the moving member 210 increases due to the elastic deformation of the bumper 224, the moving member 210 may contact the bumper 224 so that there is a less risk of breakage of the moving member 210. That is, the durability of the flow control unit 200 may be improved.

The moving member 210 may include the flow control member 212 and an insertion portion 213 protruding from one surface of the connecting portion 214 formed in the shape of a plate.

The flow control member 212 may be accommodated in the first accommodating portion 222 of the case 220, and the insertion portion 213 may be accommodated in the second accommodating portion 223 of the case 220. As the moving member 210 slides left and right, the flow control member 212 and the insertion portion 213 may be inserted into the first accommodating portion 222 and the second accommodating portion 223, respectively, or taken out of the first accommodating portion 222 and the second accommodating portion 223, respectively.

The knob 211 may be positioned on the other surface of the connecting portion 214. That is, the knob 211 may be integrated into the flow control member 212 through the connecting portion 214. Accordingly, the knob 211 and the flow control member 212 may move together.

A user may move the knob 211 between the first position and the second position so that the flow control member 212 may move between the first position and the second position.

The flow control member 212 and the insertion portion 213 may be in surface contact with the first accommodating portion 222 and the second accommodating portion 223, respectively. When a gap is made between the flow control member 212 and the first accommodating portion 222 or between the insertion portion 213 and the second accommodating portion 223, cool air may leak through the gap. When the flow control member 212 is in surface contact with the first accommodating portion 222 and the insertion portion 213 is in surface contact with the second accommodating portion 223, the gap may be reduced to reduce a leakage amount of cool air. By reducing the leakage of cool air, overcooling of the cooling container 60 or deterioration in inside temperature of the first storage room 40, which may be caused by an unintended leakage of cool air, may be prevented.

Figure 8:
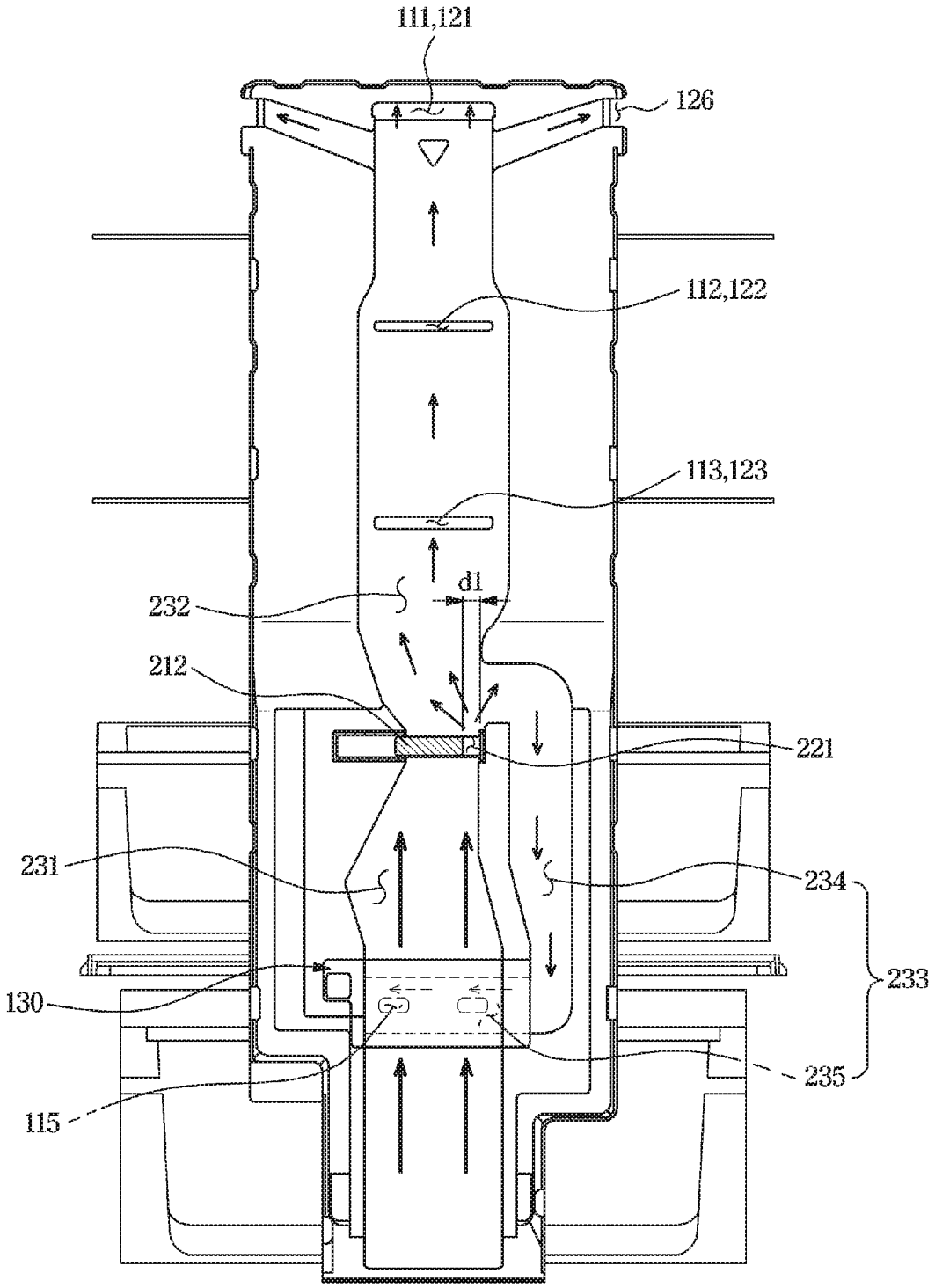
FIG. 8 shows the flow of cool air when a flow control member is at a first position in a refrigerator according to an embodiment of the disclosure.
Figure 9:
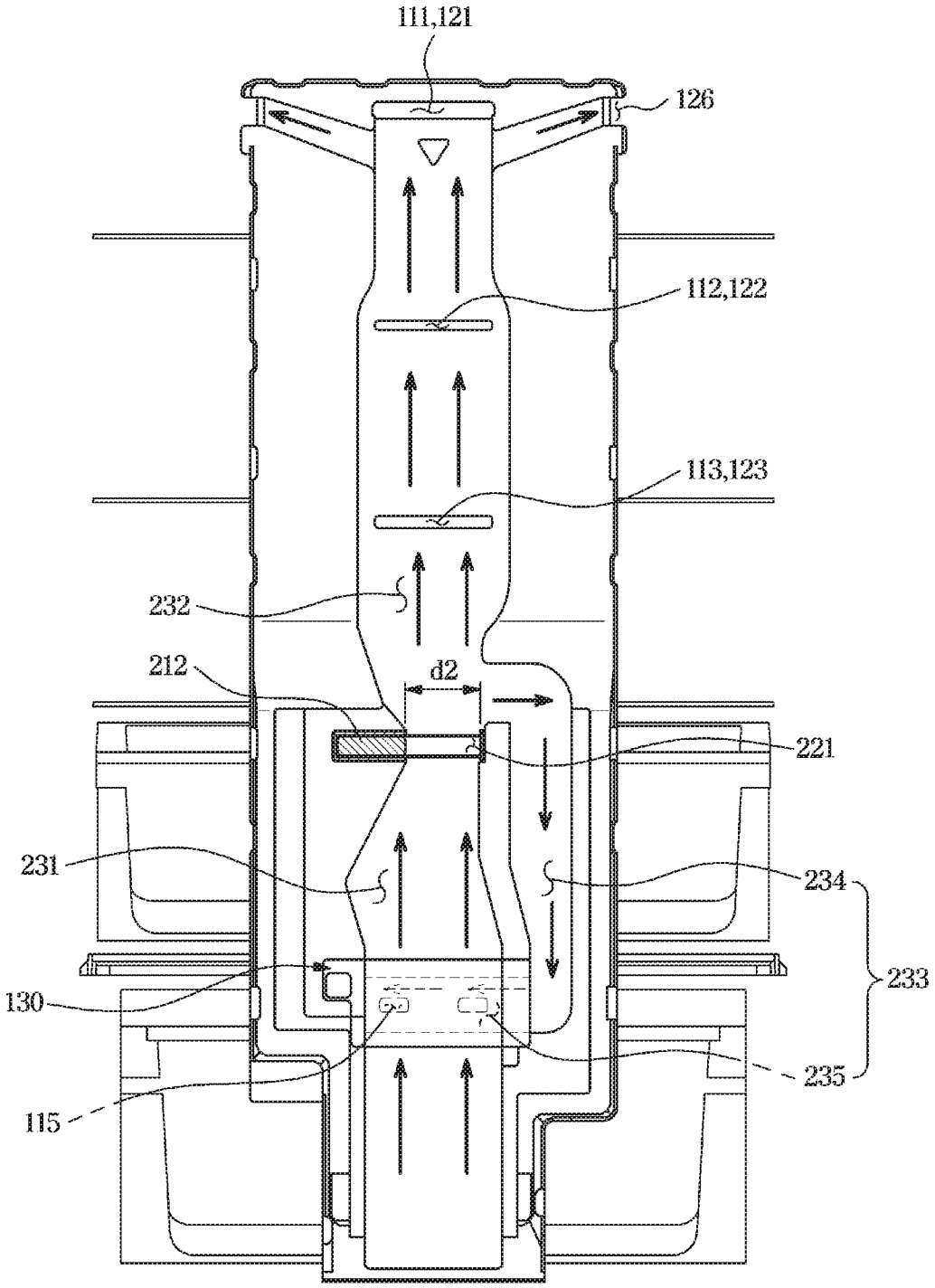
FIG. 9 shows the flow of cool air when a flow control member is at a second position in a refrigerator according to an embodiment of the disclosure.

FIG. 8 shows the flow of cool air when a flow control member is at a first position in a refrigerator according to an embodiment of the disclosure, and FIG. 9 shows the flow of cool air when a flow control member is at a second position in a refrigerator according to an embodiment of the disclosure.

Hereinafter, a flow of cool air according to a position of the flow control member in the refrigerator according to an embodiment of the disclosure will be described in detail.

Referring to FIG. 8, the flow control member 212 may be located at the first position. A temperature of the first storage room 40 and the cooling chamber 62 may change in a predetermined range. When the flow control member 212 is located at the first position, a size d1 of the flow control hole 221 may become a minimum, and a temperature of the first storage room 40 and the cooling chamber 62 may be maintained at a highest temperature in the predetermined range.

Referring to FIG. 9, the flow control member 212 may be located at the second position. A temperature of the first storage room 40 and the cooling chamber 62 may change in the predetermined range. When the flow control member 212 is located at the second position, a size d2 of the flow control hole 221 may become a maximum, and a temperature of the first storage room 40 and the cooling chamber 62 may be maintained at a lowest temperature in the predetermined range.

Cool air generated by the evaporator 52 (see FIG. 3) may move to the flow control member 212 through the first flow path 231. As described above, although the first flow path 231 partially overlaps with the second partial flow path 235 in a front-back direction, cool air may be prevented from leaking by the partition wall 130 so that cool air of the first flow path 231 may not leak to the second partial flow path 235. Accordingly, cool air of the first flow path 231 may move to the flow control member 212 without leaking out.

Cool air below the flow control member 212 may move upward from the flow control member 212 through the flow control hole 221. When the flow control member 212 is located at the first position, a size of the flow control hole 221 may become a minimum, and accordingly, an amount of cool air passing through the flow control hole 221 may also become a minimum. An amount of cool air that is supplied to the first storage room 40 and the cooling chamber 62 may become a minimum, and accordingly, a temperature of the first storage room 40 and the cooling chamber 62 may become a highest temperature in the predetermined range.

A part of cool air passed through the flow control member 212 may move upward along the second flow path 232 to be discharged to the inside of the first storage room 40 through the first cool air outlets 111, 121, 112, 122, 113, and 123 and the side outlets 126.

The remaining part of cool air passed through the flow control member 212 may move along the third flow path 233 to be discharged to the cooling chamber 62 through the second cool air outlet 115.

The third flow path 233 may include the first partial flow path 234 diverging from the second flow path 232 and extending downward, and a second partial flow path 235 extending in a side direction from an end of the first partial flow path 234.

Cool air may move downward along the first partial flow path 234, and then move in the side direction along the second partial flow path 235. The first flow path 231 and the first partial flow path 234 may be partitioned by a partition wall (a reference numeral is omitted) extending vertically, and the second flow path 232 and the second partial flow path 235 may be partitioned by the partition wall 130. Accordingly, cool air of the first flow path 231 may not leak to the first partial flow path 234 and the second partial flow path 235. That is, the cool air may pass through the first flow path 231 and the flow control member 212 and then flow to the third flow path 233.

Because the second cool air outlet 115 is positioned lower than the flow control member 212, overcooling of the cooling chamber 62 may occur when cool air on the first flow path 231 leaks to the second partial flow path 235 to be discharged to the second cool air outlet 115. The reason may be because cool air entered the first flow path 231 is discharged to the second partial flow path 235 and the second cool air outlet 115 regardless of the position of the flow control member 212.

According to a technical concept of the disclosure, because cool air entered the first flow path 231 does not leak to the first partial flow path 234, the second partial flow path 235, and the second cool air outlet 115 before passing through the flow control member 212, overcooling of the cooling chamber 62 may be prevented.

According to a technical concept of the disclosure, there is provided the refrigerator capable of improving a user's convenience by locating the knob for adjusting a temperature of the storage container above the storage container.

According to another technical concept of the disclosure, there is provided the refrigerator capable of reducing manufacturing cost and improving product competitiveness by omitting a motorized damper.

According to another technical concept of the disclosure, there is provided the refrigerator capable of preventing overcooling of the storage container, while locating the flow control member for adjusting the flow of cool air above the cool air outlets for discharging cool air to the storage container.

According to another technical concept of the disclosure, there is provided the refrigerator capable of preventing overcooling of the storage container by installing the flow path for guiding cool air to the storage container above the flow control member for adjusting the flow of cool air.

Although a few embodiments of the disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:
- a first storage room;
- a second storage room positioned below the first storage room;
- a cooling container positioned inside the first storage room and forming a cooling space maintained at a temperature that is different from a temperature of the first storage room;
- a duct including a flow path for guiding cool air to the first storage room and the cooling container; and
- a flow control unit configured to be movable on the flow path and to adjust a degree of opening of the flow path, the flow control unit including a knob configured to adjust a position of the flow control unit and positioned on the first storage room above the cooling container, wherein the flow path comprises:
- a first flow path configured to upwardly guide the cool air to the flow control unit from the second storage room,
- a second flow path for guiding the cool air to the first storage room from the flow control unit, and
- a third flow path configured to downwardly guide the cool air to the cooling space from the flow control unit.

2. The refrigerator of claim 1, wherein the duct further comprises a partition wall partitioning the first flow path from the third flow path to prevent cool air of the first flow path from entering the third flow path.

3. The refrigerator of claim 2, wherein the third flow path comprises:
- a first partial flow path diverging from the second flow path and extending downward; and
- a second partial flow path extending sideways from the first partial flow path.

4. The refrigerator of claim 3, wherein based on removing the cooling container out of the first storage room in a forward direction, the first flow path is partitioned from the second partial flow path in the forward direction by the partition wall.

5. The refrigerator of claim 1, wherein the flow control unit comprises:
- a case including a flow control hole that is positioned on the flow path and configured to allow the cool air to pass through; and a flow control member slidingly coupled with the case and configured to adjust a size of the flow control hole.

6. The refrigerator of claim 5, wherein the knob is slidingly coupled with the case and configured to adjust a position of the flow control member.

7. The refrigerator of claim 6, wherein the knob is integrated into the flow control member and configured to move together with the flow control member.

8. The refrigerator of claim 5, wherein:

the flow control member is configured to move between a first position for opening the flow control hole to a first size and a second position for opening the flow control hole to a second size; and the second size is different from the first size.

9. The refrigerator of claim 8, wherein:

the case comprises an accommodating portion that the flow control member is inserted into or taken out of;

based on inserting the flow control member into the accommodating portion, a size of the flow control hole increases; and based on taking out the flow control member of the accommodating portion, a size of the flow control hole decreases.

10. The refrigerator of claim 9, wherein the flow control member is in surface contact with the accommodating portion to prevent the cool air from leaking between the flow control member and the accommodating portion.

11. The refrigerator of claim 1, further comprising a storage container positioned inside the first storage room and positioned above the cooling container, wherein the knob is positioned above the storage container.

12. The refrigerator of claim 1, wherein an evaporator configured to generate cool air is positioned in the second storage room.

13. A refrigerator comprising:

a first storage room;

a second storage room positioned below the first storage room and including an evaporator configured to generate cool air;

a cooling container forming a cooling space maintained at a temperature that is different from a temperature of the first storage room, wherein the cooling container is configured to be taken out in a forward direction from the first storage room;

a first flow path for guiding the cool air from the evaporator to the first storage room;

a second flow path for guiding the cool air to the cooling space, wherein the second flow path includes:

a first partial flow path diverging from the first flow path from above a flow control unit and extending downward; and a second partial flow path extending sideways from the first partial flow path; and a partition wall that partitions the second flow path from the first flow path in the forward direction to prevent cool air of the first flow path from entering the second flow path.

14. The refrigerator of claim 13, further comprising:

a flow control unit movably positioned on the first flow path and configured to adjust a degree of opening of the first flow path; and a knob configured to adjust a position of the flow control unit and positioned above the cooling container.

15. The refrigerator of claim 14, wherein the flow control unit comprises:

a case including a flow control hole that is positioned between the first flow path and the second flow path and configured to allow the cool air to pass through; and a flow control member slidingly coupled with the case and configured to adjust a size of the flow control hole.

16. The refrigerator of claim 13, wherein the partition wall partitions the first flow path from the second partial flow path in the forward direction.

* * * * *